United States Patent [19]

Bryanos

[11] Patent Number: 4,811,028

[45] Date of Patent: Mar. 7, 1989

[54] QUADRIDGE ANTENNA FOR SPACE VEHICLE

[75] Inventor: James C. Bryanos, Nahant, Mass.

[73] Assignee: Avco Corporation, Providence, R.I.

[21] Appl. No.: 6,811

[22] Filed: Jan. 20, 1987

[51] Int. Cl.[4] ..... H01Q 13/02; H01Q 1/28

[52] U.S. Cl. ..... 343/786; 343/705

[58] Field of Search ..... 343/786, 785, 705, 772, 343/872, 873

[56] References Cited

U.S. PATENT DOCUMENTS

| | | | |
|---|---|---|---|
| 3,380,057 | 4/1968 | Osborn | 343/786 |
| 3,458,862 | 7/1969 | Franks | 343/786 |
| 3,611,396 | 10/1971 | Jones | 343/786 |
| 4,307,403 | 12/1981 | Yamada et al. | 343/914 |
| 4,554,552 | 11/1985 | Alford et al. | 343/786 |
| 4,577,196 | 3/1986 | Yu | 343/705 |

FOREIGN PATENT DOCUMENTS

| | | | |
|---|---|---|---|
| 30143 | 3/1977 | Japan | 343/786 |
| 30302 | 3/1981 | Japan | 343/786 |

*Primary Examiner*—William L. Sikes
*Assistant Examiner*—Michael C. Wimer
*Attorney, Agent, or Firm*—Abraham Ogman

[57] ABSTRACT

The invention is directed to a quadridge antenna situated within a quadri-fluted module. The tips of the ridge elements are recessed a distance below the surface of the window aperture.

4 Claims, 3 Drawing Sheets

Fig. 3.
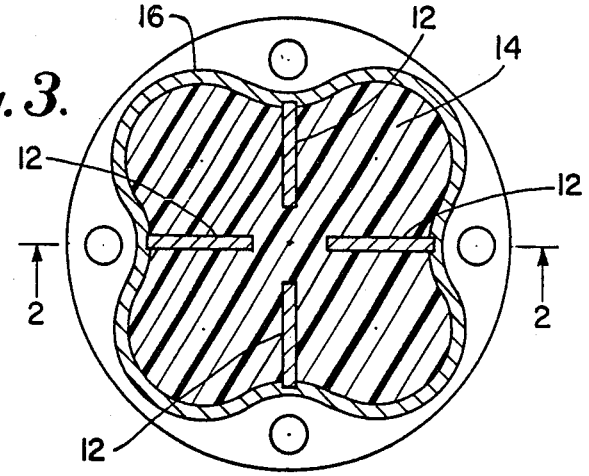
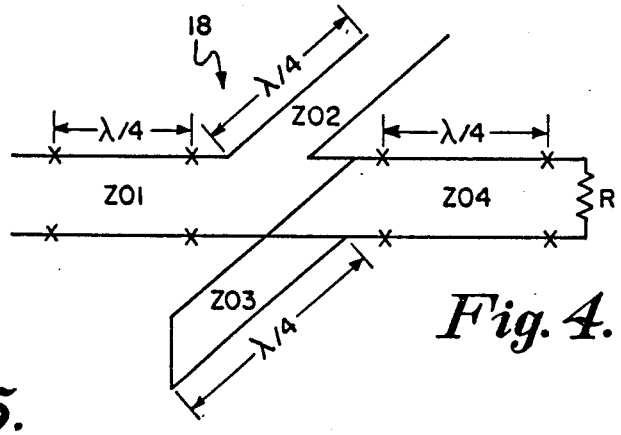
Fig. 4.
Fig. 5.
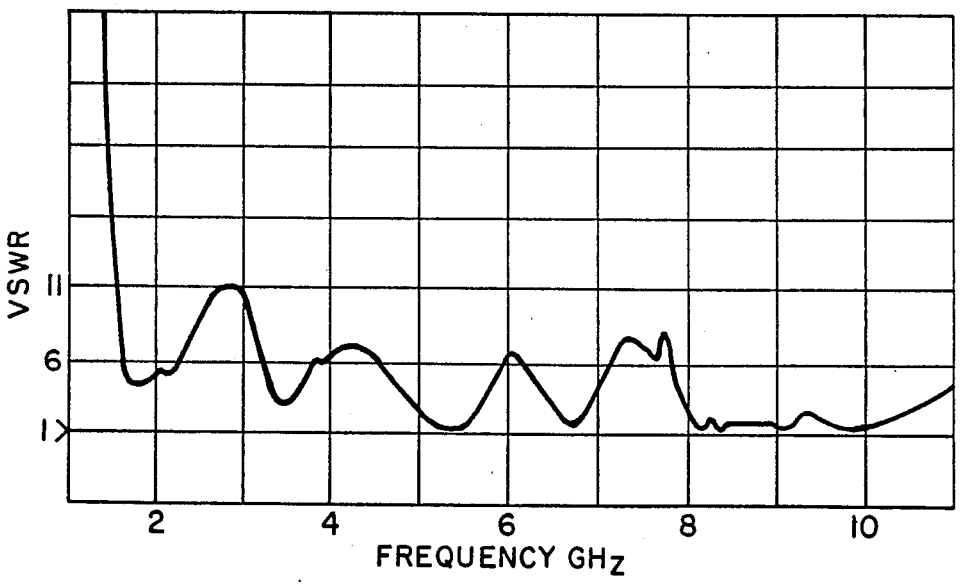

*Fig. 6.*
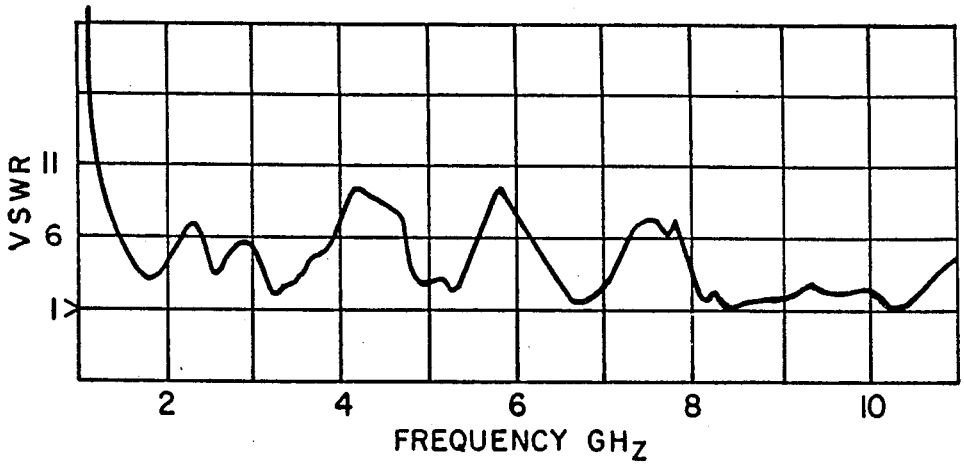
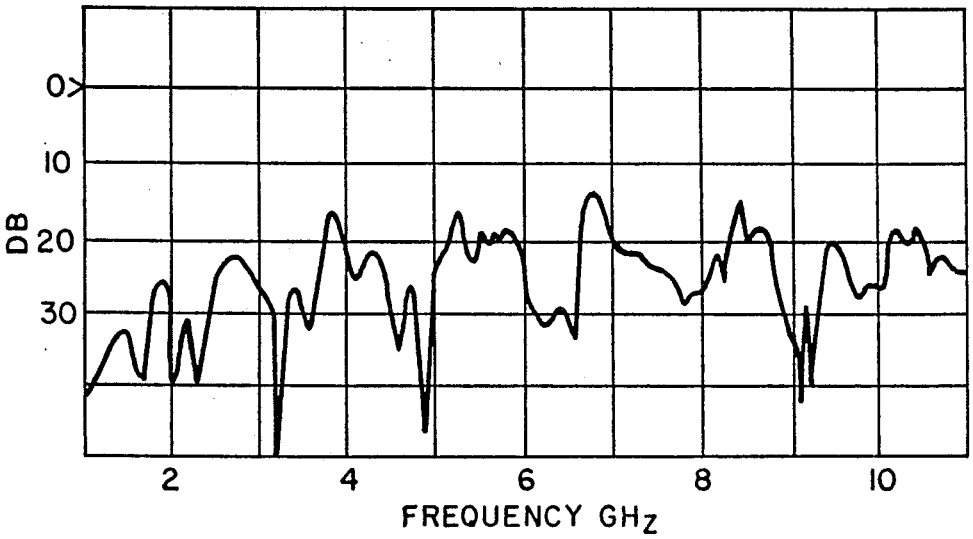
*Fig. 7.*

QUADRIDGE ANTENNA FOR SPACE VEHICLE

BACKGROUND OF THE INVENTION

This invention relates to an improved broadband radio frequency antenna operable through a window in an ablative heat shield of a reentry vehicle.

The U.S. Pat. No. (4,006,480) describes an antenna window which functions in the ablative environment of a vehicle reentering the atmosphere from space. Charette et al disclose a window whose forward edge is below the level of the heat shield while the trailing edge of the window is raised above the level of the adjacent heat shield. The resulting abrupt steps at the window-heat shield interfaces diverts air flow precluding severe local material loss due to differences in the ablation rates of the two materials.

In U.S. Pat. No. 3,739,386 to Jones an antenna for a space projectile is disclosed comprising a plurality of concentric ring radiating elements situated in the base of the vehicle. Each radiating element is a plated, dielectric loaded cavity extending around the circumference of the ring. The elements may be stacked and collectively phased to produce a desired radiation pattern.

Neither of these patents disclose the purpose of the subject invention which is to provide an antenna which can transmit and receive information over a wide frequency range through a window in an ablative heat shield.

SUMMARY OF THE INVENTION

The invention provides a simple and inexpensive solution for preventing operational degradation of an antenna because of window material loss due to the ablation created during the reentry phase of flight. I discovered that a miniaturized quadridge antenna with polarization diversity will satisfy the broadband radio frequency transmit and receive requirement. The antenna consists of a module mounted in an opening in the space vehicle wall. The module is dielectrically filled to isolate the interior from the exterior environment. The outward extending first end of the module forms a window that is transparent to radio waves. Imbedded within the module are four planary ridge elements, each positioned along a radius of the module with spacing being 90 degrees apart. The outer edges of the four ridge elements are coincident with the sidewall surface of the module, the first end of each ridge element is coincident with the second end of the module, the center axis facing edge of each ridge element is tapered from its widest value at the second end of the module to a minimum value at the window facing end. The length of the ridge elements is chosen such that the window facing ends are recessed below the surface of the window aperture. Element taper is chosen such that the spacing between the center axis of the module and the inward facing edge of each ridge element appears as a truncated right hyperbolic triangle resulting in a constant impedance along the device length. With the window facing ends of the ridge elements recessed below the window surface, no damage will occur to the elements during the reentry phase of flight.

To counter degradation of antenna performance at low operating frequencies caused by internal reflections in the ridgeless window region of the dielectric material, the transverse cross section of the antenna module is made either round nor square. Rather, it is formed to have a radius from the center of the module which is defined by the equation $$R(x)=a+b\sin 4x$$

Where a and b are constants and x includes all values between 0 and 360 degrees.

Thus, if a=5 and b=1 at some particular transverse slice, the radius will range from a least value of 4 to a maximum value of 6. In cross section then, the antenna module appears somewhat like a gear with 4 teeth. The four ridge elements are positioned along the zones of smallest radius. Configured as a cruciform array, when viewed at the second end of the module efficient electromagnetic field propagation is supported under all conditions.

It is therefore an object of the invention to provide a new and improved combination window and broadband antenna for use in an ablative heat shield which is easily assembled.

It is a further object of this invention to provide a new and improved combination window and antenna whose performance does not degrade during the reentry phase of flight.

These and other objects of the invention will become more apparent from the following description taken in connection with the illustrative embodiment shown in the drawings.

BRIEF DESCRIPTION OF THE DRAWINGS

FIG. 3 is a transverse cross section facing toward the antenna base.

FIG. 4 is a chematic eqivalent of the compensated balun bandpass filter used as a transition feed from a coaxial cable.

FIG. 5 is a graph of VSWR versus frequency measured at antenna port No. 1 for the system reduced to practice.

FIG. 6 is a graph of VSWR versus frequency measured at antenna port No. 2.

FIG. 7 is a graph of Port 1 to Port 2 isolation as a function of frequency.

DETAILED DESCRIPTION OF THE PREFERRED EMBODIMENT

Figure 1:
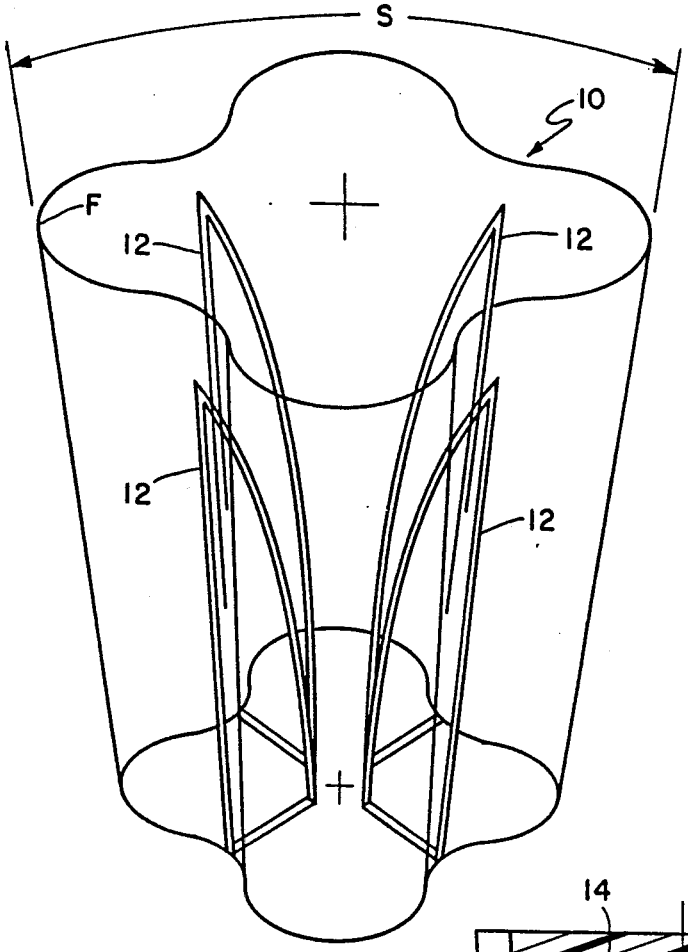
FIG. 1 is a perspective view of the quadridge antenna module showing the positioning of the ridge elements below the maximum ablation level of the dielectric.
Figure 2:
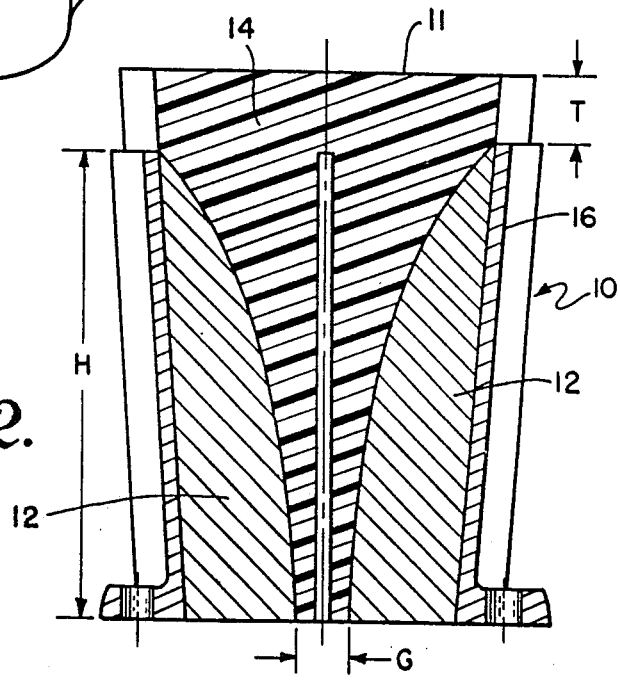
FIG. 2 is a cross sectional view of the antenna module facing as shown by line 2—2 of FIG. 3.

FIGS. 1–3 show the quadri-fluted antenna module 10, formed in a configuration which was found to minimize ablation effects. Radio frequency transmission and reception pass through window aperture 11. Conductive waveguide ridge elements 12 are positioned every 90 degrees around the circumference. In the side view of FIG. 2 and the top view of FIG. 3, it will be seen that each of the four ridge elements comprise a thin flat strip of metal which is tapered in width. Typically, the thickness of the stock from which ridge elements 12 were formed was 0.120 in. The four ridge elements 12 are imbedded in dielectric 14. The length of each ridge element 12 (Designated H in FIG. 2) is a half wavelength when measured in terms of the lowest operating frequency being transmitted when measured in terms of wavelengths as they exist within the dielectric medium. Antenna VSWR is calculable by taking into account slope S (see FIG. 1), ridge element taper, gap width G (see FIG. 2) and the parameters of conductive shield 16.

The quadri-fluted cross sectional configuration of antenna module 10 is defined by a radius having the form $$R=a+b \sin 4\,(+k)$$

where x includes all values from 0 to 360 degrees and K equals a constant. For example, in the FIG. 3 implementation a =6.7, b=1 and k=(−22.5 degrees). For FIG. 3, ridge elements 12 are inserted at the minimum radius points, namely, where x equals 0, 90, 180 and 270 degrees respectively. The outer edges of ridge elements 12 are in mechanical and electrical contact with conductive shield 16 which encircles the antenna module except for the top around window aperture 11. The base portion of conductive shield 16 is flanged to enable attachment of the waveguide antenna feed. In the system reduced to practice, the antenna feed was a compensated balun 18 constructed of quarter wave transmission line sections whose equivalent circuit is shown in FIG. 4. The design comprises the use of two identical coax to quadridge transitions in circular waveguide cavities. Initial test results are shown in FIGS. 5–7 for a dielectric filled antenna having ridge elements 0.120 in. thick, a gap (G) of 0.020 in., and an overall antenna assembly length of 2 inches. FIG. 5 is a graph of VSWR versus frequency in GH for Antenna port No. 1. FIG. 6 is a graph of VSWR versus frequency in G for Antenna port No. 2. FIG. 7 shows port 1 to port 2 isolation. It is to be noted that the achieved VSWR is better than 6 to 1 almost everywhere over the frequency range of 2 to 11 GHz.

In order to preserve antenna performance during reentry, the outermost tips of ridge elements 12 (see FIGS. 1 and 2) are recessed an amount T below the surface of the window aperture 11. This is done to prevent ridge element deformation by ablation. Additionally, it was discovered that the quadri-fluted aperture cross section shown in FIG. 1 enhances antenna performance at the low operating frequencies by providing more efficient electromagnetic field propagation. As previously defined, the radius at any transverse slice through the antenna is of the form $$R=a+b \sin 4(x+k).$$

The tips of the ridge elements will thus be located within a circle whose radius is (a−b). The dielectric material at radius values beyond (a−b) serve to maximize antenna performance. Therefore, when ripples begin to form in the window surface due to ablation caused by reentry, the aperture configuration of the antenna is not degraded; maintaining efficient transmission and radiation pattern characteristics.

It is to be understood that the foregoing disclosure of the preferred embodiment is intended to merely exemplify the invention. Modification and alterations may be made therein and in the mode of coupling transmitters and receivers to the antenna without departing from the spirit and scope of the invention as set forth in the claims.

I claim:

1. A quadridge antenna comprising:

an elongated electrically conducting module having a predetermined length and a generally fluted cross section defined by a radius "R" whose value varies according to the equation $$R(x)=a+b \text{ Sin } 4x$$

where a and b are constants and x varies from 0 to 360 degrees thereby defining a fluted structure with minimum radii and maximum radii;

four planary ridge elements each having a back edge of said predetermined length, each of said ridge elements projecting radially from said module with the back edge joined to the module at a minimum radius; and means for coupling radio frequency energy to the module and ridge elements.

2. An antenna as defined in claim 1 where the antenna includes a dielectric surface spaced from the module defining the antenna window aperture and said ridge elements and module are recessed from the surface defining the window aperture.

3. An antenna as defined in claim 1 where the module is filled with a dielectric material configured to conform to the fluted structure of the module, said dielectric material having a length greater than the predetermined length of the module and terminating in a surface which defines a window aperture whereby the ridges are recessed below the surface defining the window aperture.

4. A quadridge antenna comprising:

a quadri-fluted electrically conductive module having a sinusoidal cross sectional configuration defined by four minimum radii and four maximum radii and a predetermined length;

four planary ridge elements each having a back edge of said predetermined length, each of said ridge elements projecting radially from said module with the back edge joined to the module at a minimum radius; and means for coupling radio frequency energy to the module and ridge elements.

* * * * *